US006044734A

United States Patent [19]

Sellers et al.

[11] Patent Number: 6,044,734

[45] Date of Patent: Apr. 4, 2000

[54] PLIERS

[76] Inventors: Larry R. Sellers; Lucille J. Sellers, both of 283 Garman Dr., Chambersburg, Pa. 17201-3333

[21] Appl. No.: 09/026,420

[22] Filed: Feb. 19, 1998

[51] Int. Cl.[7] ..... B25B 7/00

[52] U.S. Cl. ..... 81/427.5; 81/489

[58] Field of Search ..... 81/427.5, 177.2, 81/489; 30/260, 135, 194; 16/11 OR

[56] References Cited

U.S. PATENT DOCUMENTS 1,305,873 6/1919 Briggs ..... 81/427.5
1,461,270 7/1923 Garrison ..... 81/427.5
2,951,259 9/1960 Brockner ..... 81/427.5
5,251,380 10/1993 Craig ..... 30/329

*Primary Examiner*—Timothy V. Eley
*Assistant Examiner*—Sinclair Skinner

[57] ABSTRACT

A new pair of pliers for allowing easy grasping of the handles during use. The inventive device includes first and second arm members each having a jaw portion, a mid portion, and a handle portion. The mid portions of the arm members are pivotally coupled together such that the jaw portions oppose each other. The handle portions of the arm members are in a pivotal relationship with one another. An arcuate gripping handle is positioned between the handle portions of the arm members and is coupled to the handle portion of the first arm member.

8 Claims, 6 Drawing Sheets

PLIERS

BACKGROUND OF THE INVENTION

1. Field of the Invention

The present invention relates to pliers and more particularly pertains to a new pliers for allowing easy grasping of the handles during use.

2. Description of the Prior Art

The use of pliers is known in the prior art. More specifically, pliers heretofore devised and utilized are known to consist basically of familiar, expected and obvious structural configurations, notwithstanding the myriad of designs encompassed by the crowded prior art which have been developed for the fulfillment of countless objectives and requirements.

Known prior art pliers include U. S. Pat. No. 4,903,558; U.S. Pat. No. Des. 344,224; U.S. Pat. No. Des. 259,854; U.S. Pat. No. Des. 310,951; U.S. Pat. No. Des. 297,802; and U.S. Pat. No. Des. 343,779.

While these devices fulfill their respective, particular objectives and requirements, the aforementioned patents do not disclose a new pliers. The inventive device include, first and second arm members each having a jaw portion, a mid portion, and a handle portion. The mid portions of the arm members are pivotally coupled together such that the jaw portions oppose each other. The handle portions of the arm members are in a pivotal relationship with one another. An arcuate gripping handle is positioned between the handle portions of the arm members and is coupled to the handle portion of the first arm member.

In these respects, the pliers according to the present invention substantially departs from the conventional concepts and designs of the prior art, and in so doing provides an apparatus primarily developed for the purpose of allowing easy grasping of the handles during use.

SUMMARY OF THE INVENTION

In view of the foregoing disadvantages inherent in the known types of pliers now present in the prior art, the present invention provides a new pliers construction wherein the same can be utilized for allowing easy grasping of the handles during use.

The general purpose of the present invention, which will be described subsequently in greater detail, is to provide a new pliers apparatus and method which has many of the advantages of the pliers mentioned heretofore and many novel features that result in a new pliers which is not anticipated, rendered obvious, suggested, or even implied by any of the prior art pliers, either alone or in any combination thereof.

To attain this, the present invention generally comprises first and second arm members each having a jaw portion, a mid portion, and a handle portion. The mid portions of the arm members are pivotally coupled together such that the jaw portions, oppose each other. The handle portions of the arm members are in a pivotal relationship with one another. An arcuate gripping handle is positioned between the handle portions of the arm members and is coupled to the handle portion of the first arm member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pliers apparatus and method which has many of the advantages of the pliers mentioned heretofore and many novel features that result in a new pliers which is not anticipated, rendered obvious, suggested, or even implied by any of the prior art pliers, either alone or in any combination thereof.

It is another object of the present invention to provide a new pliers which may be easily and efficiently manufactured and marketed.

It is a further object of the present invention to provide a new pliers which is of a durable and reliable construction.

An even further object of the present invention is to provide a new pliers which is susceptible of a low cost of manufacture with regard to both materials and labor, and which accordingly is then susceptible of low prices of sale to the consuming public, thereby making such pliers economically available to the buying public.

Still yet another object of the present invention is to provide a new pliers which provides in the apparatuses and methods of the prior art some of the advantages thereof, while simultaneously overcoming some of the disadvantages normally associated therewith.

Still another object of the present invention is to provide a new pliers for allowing easy grasping of the handles during use.

Yet another object of the present invention is to provide a new pliers which includes first and second arm members each having a jaw portion, a mid portion, and a handle portion. The mid portions of the arm members are pivotally coupled together such that the jaw portions oppose each other. The handle portions of the arm members are in a pivotal relationship with one another. An arcuate gripping handle is positioned between the handle portions of the arm members and is coupled to the handle portion of the first arm member.

Still yet another object of the present invention is to provide a new pliers that allows a user to apply more pressure while gripping the pliers.

Even still another object of the present invention is to provide a new pliers that helps add additional leverage when using the pliers.

Still even yet another object of the present invention is to provide a new pliers that is easier to use in tight spaces than traditional pliers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
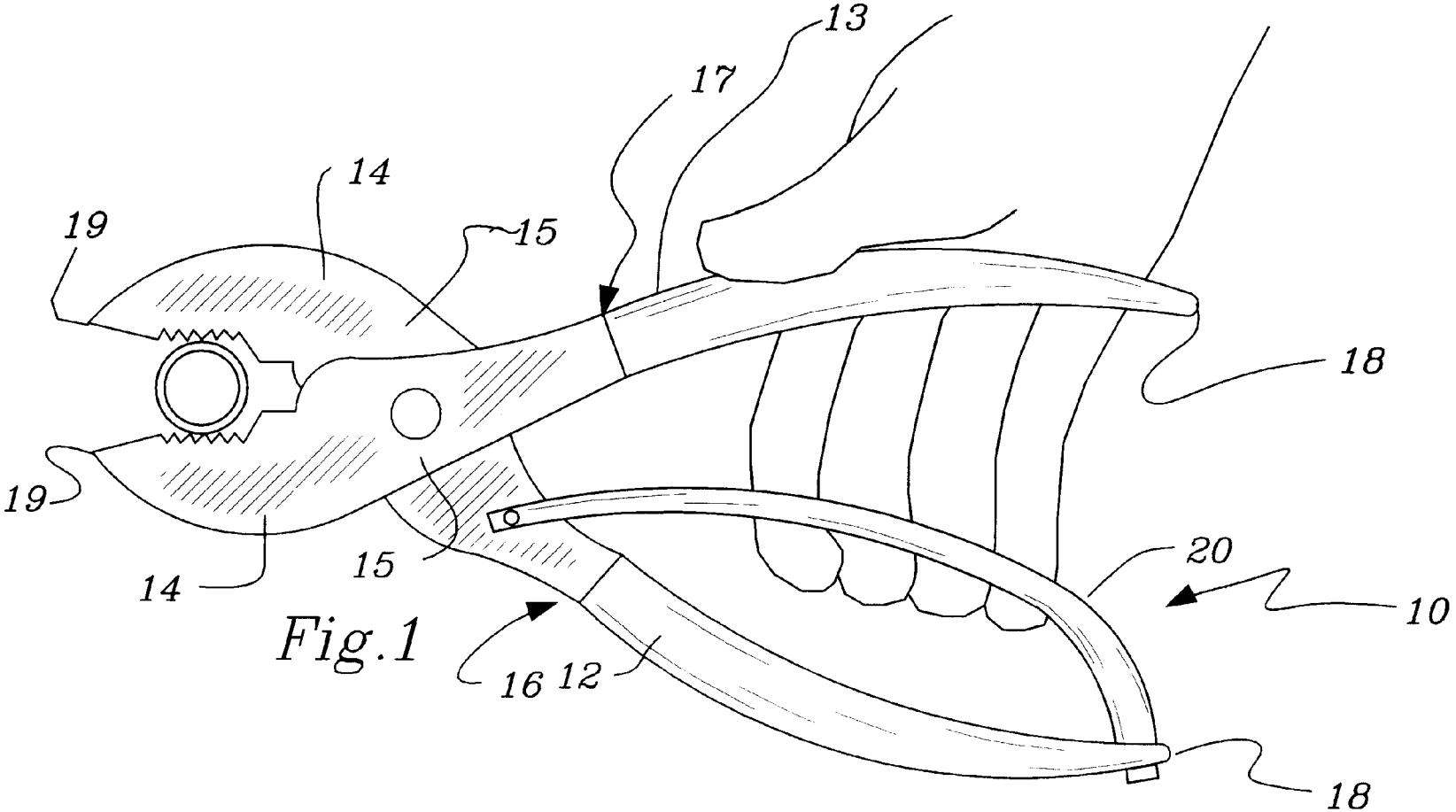
FIG. 1 is a schematic side view of a new pliers according to the present invention.
Figure 2:
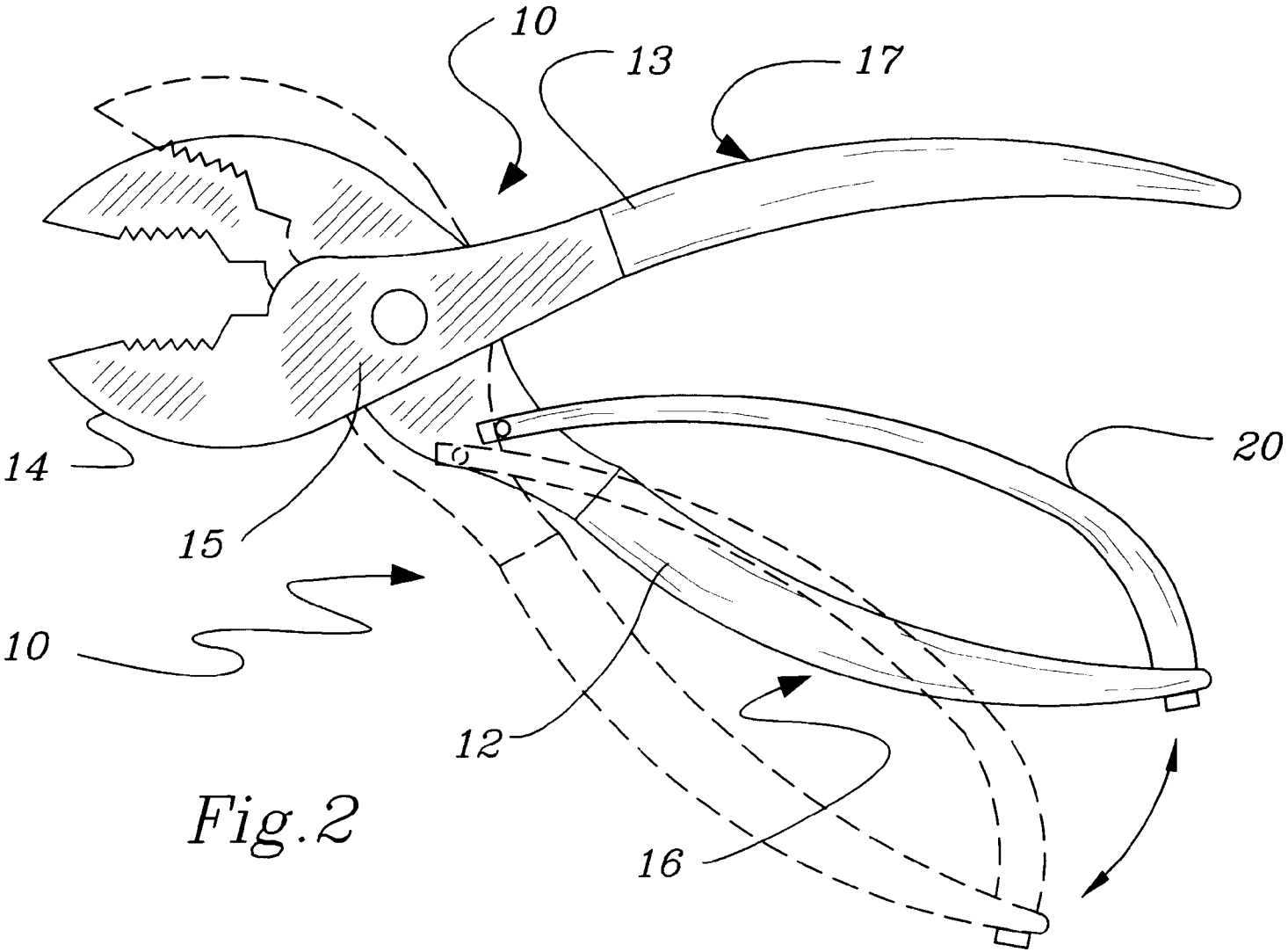
FIG. 2 is a schematic side view of the present invention illustrating the pivoting of the invention.

With reference now to the drawings, and in particular to FIGS. 1 through 8 thereof, new pliers embodying the principles and concepts of the present invention and generally designated by the reference numeral 10 will be described.

As best illustrated in FIGS. 1 through 8, the pliers 10 generally comprises first and second arm members 12,13 each having a jaw portion 14, a mid portion 15, and a handle portion. The mid portions 15 of the arm members are pivotally coupled together such that the jaw portions 14 oppose each other. The handle portions of the arm members are in a pivotal relationship with one another. An arcuate gripping handle 20 is positioned between the handle portions of the arm members and is coupled to the handle portion 16 of the first arm member 12.

In closer detail, the pliers 10 has first and second arm members 12,13. Each arm member has proximal and distal ends 18,19, a jaw portion, a mid portion, and a handle portion. The jaw portion 14 is positioned opposite the handle portion with the jaw portion 14 located towards the distal end 19 and the handle portion located towards the proximal end 18. The mid portions 15 of the arm members 12,13 are pivotally coupled together such that the jaw portions 14 oppose each other. The handle portions 16,17 of the arm members 12,13 are in a pivotal relationship with one another. Each of the handle portions 16,17 has proximal and distal ends with their distal ends located towards their associated mid portion 15 and their proximal ends at the proximal end of their associated arm member.

The arcuate gripping handle 20 has a pair of opposite ends and is positioned between the handle portions 16,17 of the arm members 12,13. The ends of the gripping handle 20 are coupled to the handle portion 16 of the first arm member 12, with one of the ends of the gripping handle 20 located towards the proximal end of the handle portion 16 of the first arm member 12 and the other end of the gripping handle 20 located towards the distal end of the handle portion 16 of the first arm member 12. As illustrated in FIG. 1, the gripping handle 20 is designed for grasping with the fingertips to easily pivot the handle portions with respect to one another. Preferably, with reference to FIGS. 5 and 6, the ends of the gripping handle 20 are detachably coupled to the handle portion 16 of the first arm member 12 by threaded fasteners 30,31 for permitting easy removal and attachment of the gripping handle 20.

Figure 7:
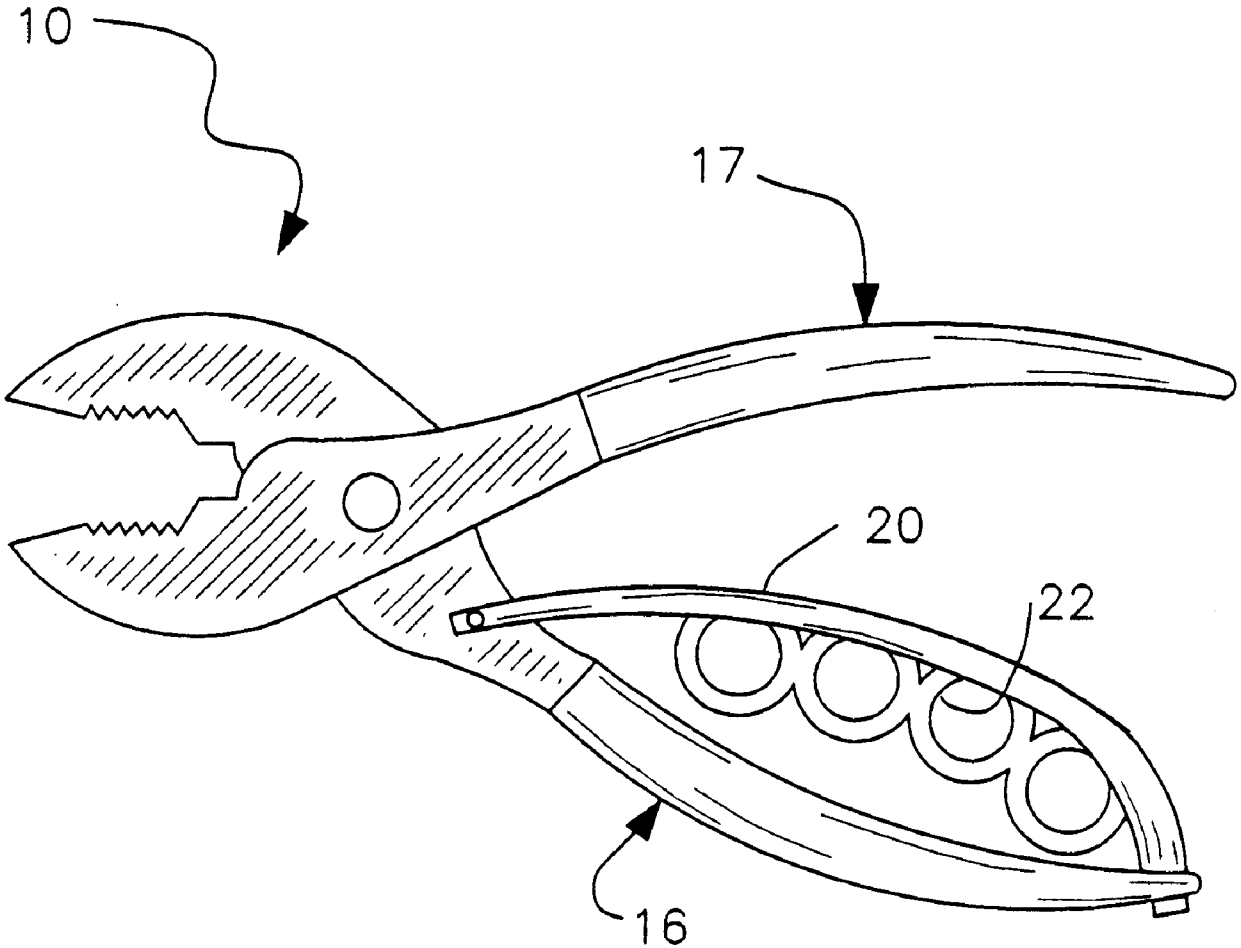
FIG. 7 is a schematic side view of the finger ring embodiment of the present invention.
Figure 8:
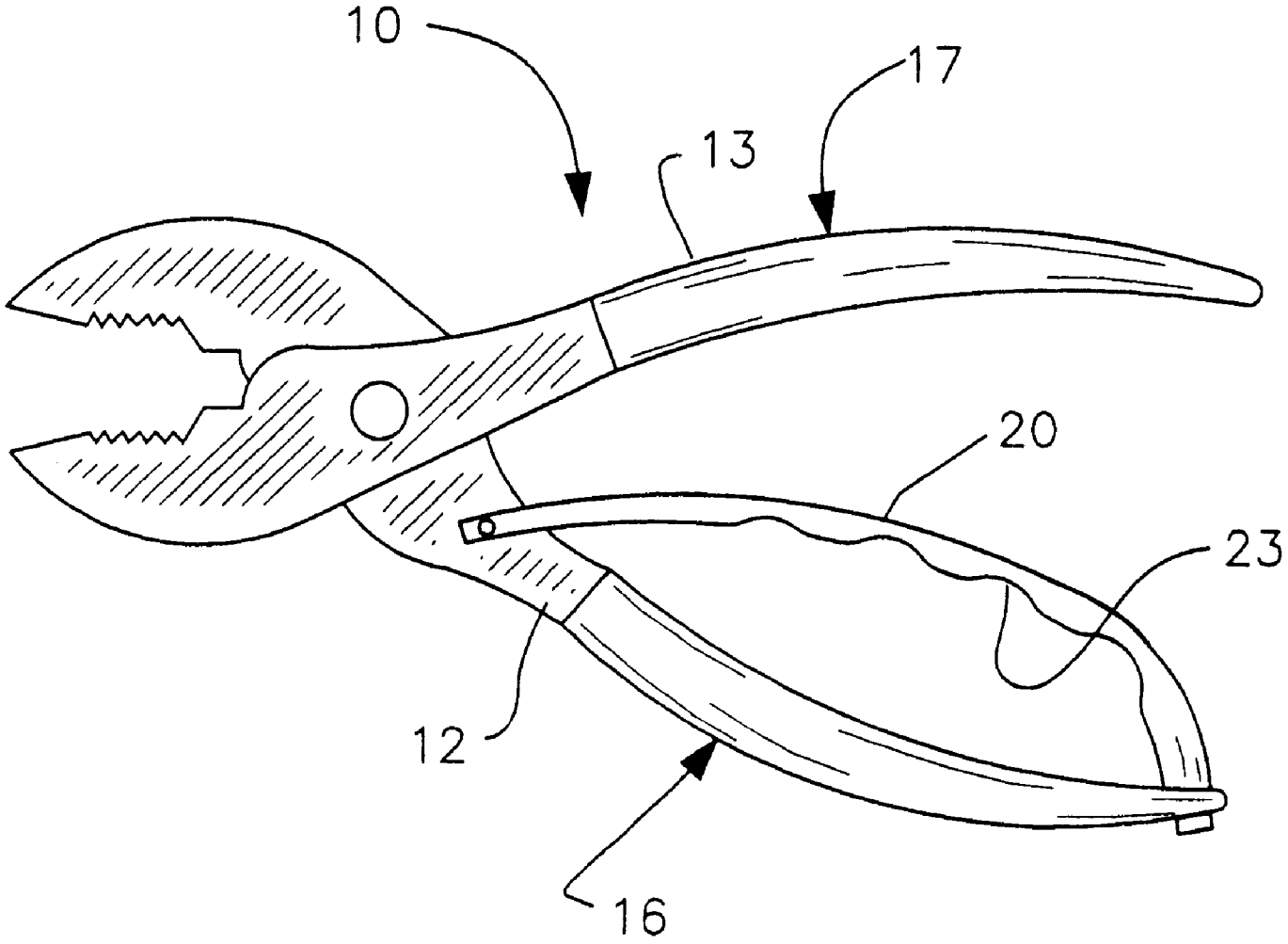
FIG. 8 is a schematic side view of the finger groove embodiment of the present invention.

Optionally, as shown in FIG. 7, the gripping handle 20 may includes a plurality of finger rings 22 extending from it with the finger rings 22 are positioned between the gripping handle 20 and the handle portion 16 of the first arm member 12. The finger rings 22 are designed for providing additional grip to a user grasping the gripping handle 20. In another optional embodiment, the gripping handle 20 may include a plurality of finger grooves 23 with the finger grooves 23 ideally facing the handle portion 16 of the first arm member 12. The finger grooves 23 are designed for providing additional grip and comfort to a user grasping the gripping handle 20.

Figures 3, 4:
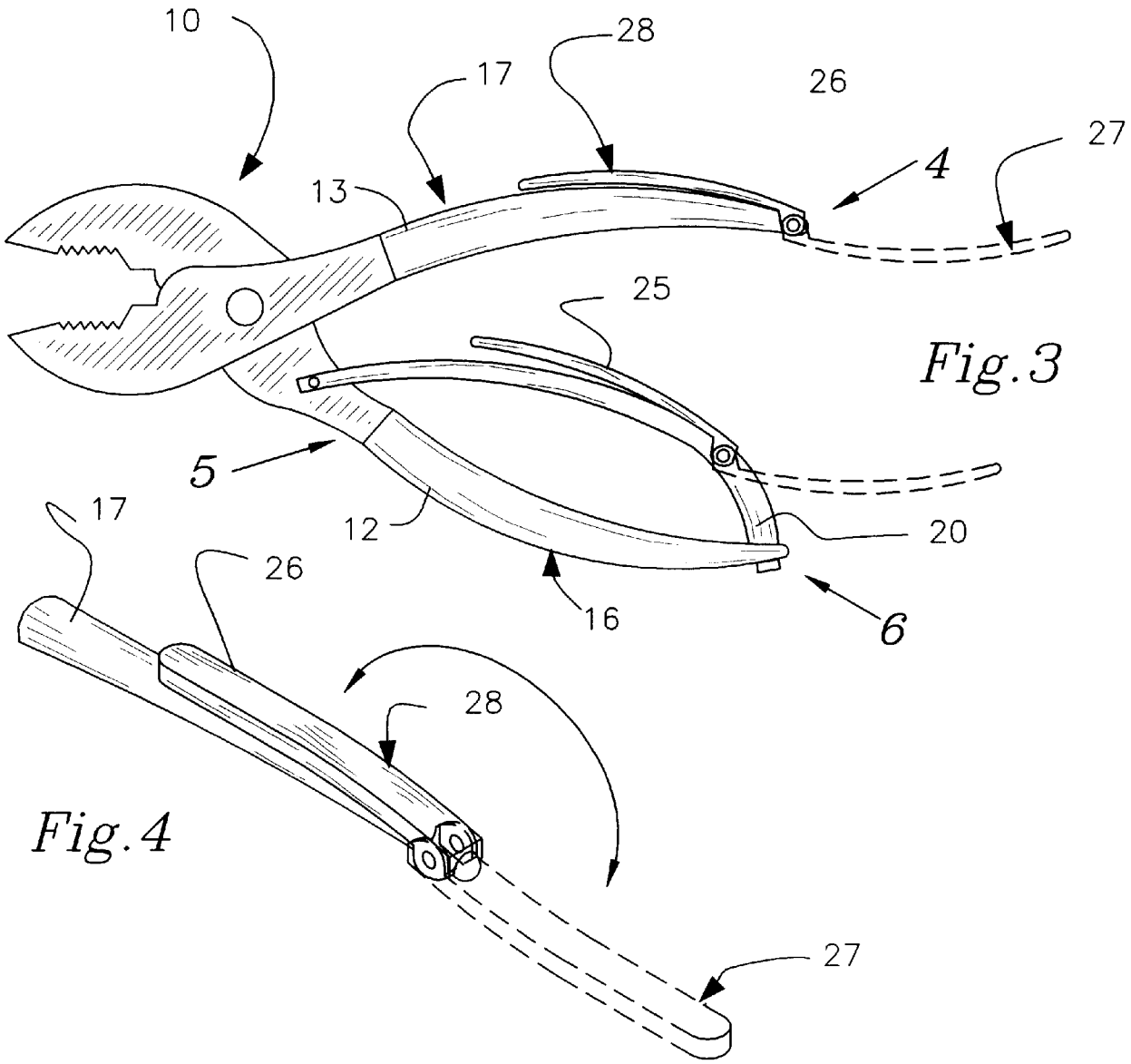
FIG. 3 is a schematic side view of the embodiment of the present invention having extension handles.
FIG. 4 is a schematic perspective view of the second extension handle of the present invention from the vantage of the arrow 4 of FIG. 3.
Figure 6:
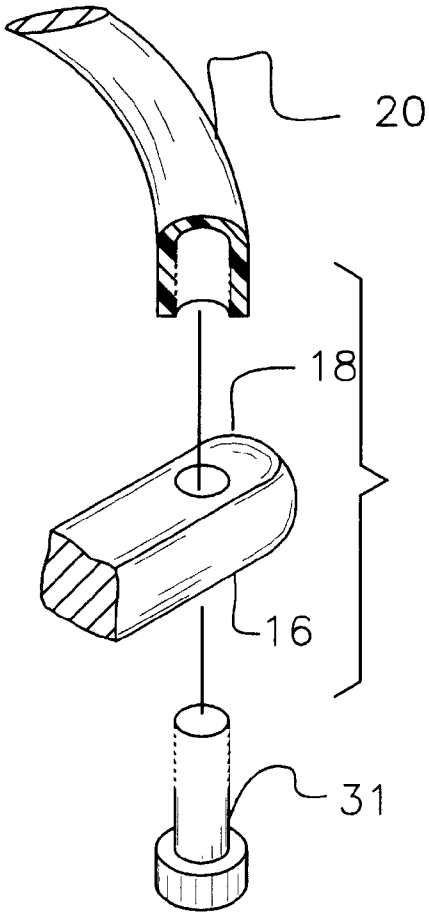
FIG. 6 is a schematic partial perspective view of the other end of the gripping handle of the present invention from the vantage of the arrow 6 of FIG. 3.
Figure 5:
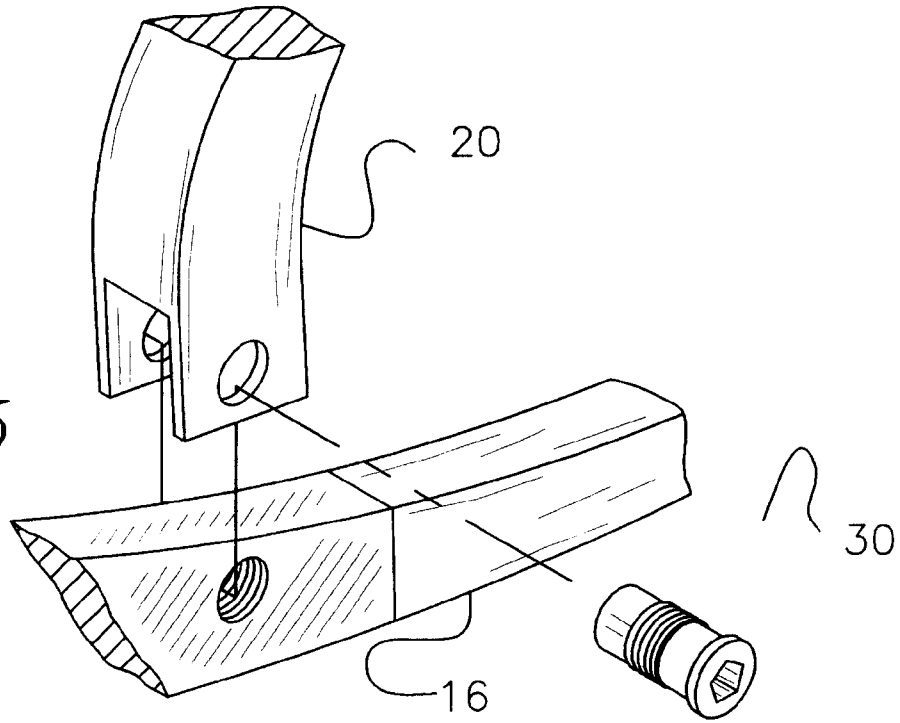
FIG. 5 is a schematic partial perspective view of one end of the gripping handle of the present invention from the vantage of the arrow 5 of FIG. 3.

In an ideal embodiment of the invention as shown in FIGS. 3 and 4, elongate first and second extension handles 25,26 are provided. The first extension handle 25 has a pair of opposite ends with one of the ends of the first extension handle 25 slidably mounted to the gripping handle 20 such that the first extension handle 25 may be slid along the gripping handle 20. Preferably, the gripping handle 20 has a notch (not shown) positioned towards the proximal end of the handle portion 16 of the first arm member 12 so that end of the first extension handle 25 is positionable in the notch. The notch is designed for holding the first extension handle 25 in an extended position outwardly from the proximal end of the handle portion 16 of the first arm member 12.

The elongate second extension handle 26 has a pair of opposite ends with one of the ends of the second extension handle 26 pivotally coupled to the handle portion 17 of the second arm member 13. The second extension handle 26 is pivotable between an extended position 27 and a closed position 28. The second handle outwardly extends from the proximal end of the handle portion 17 of the second arm member 13 when in the extended position 27 while the length of the second handle is positioned adjacent the handle portion 17 of the second arm member 13 when in the closed position 28. In use, the first extension handle 25 and the second extension handle 26 are designed for providing a user with extended handles to increase the reach of the pliers and to increase the leverage of the handles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. Pliers, comprising:

first and second handle portions being in a pivotal relationship with one another, each of said handle portions having proximal and distal ends;

an arcuate gripping handle being positioned between said handle portions, said gripping handle being coupled to said first handle portion; and a first extension handle slidably mounted to said gripping handle.

2. The pliers of claim 1, wherein said gripping handle has a plurality of finger rings extending therefrom, said finger rings being positioned between said gripping handle and said first handle portion.

3. The pliers of claim 1, wherein said gripping handle has a plurality of finger grooves.

4. Pliers, comprising:

first and second handle portions being in a pivotal relationship with one another, each of said handle portions having proximal and distal ends;

an arcuate gripping handle being positioned between said handle portions, said gripping handle being coupled to said first handle portion; and an elongate first extension handle having a pair of opposite ends, one of said ends of said first extension handle being slidably mounted to said gripping handle.

5. The pliers of claim 4, further comprising an elongate second extension handle having a pair of opposite ends, one of said ends of said second extension handle being pivotally coupled to said second handle portion.

6. Pliers, comprising:

first and second arm members, each arm member having proximal and distal ends, a jaw portion, a mid portion, and a handle portion, said mid portions of said arm members being pivotally coupled together such that said jaw portions oppose each other;

said handle portions of said arm members being in a pivotal relationship with one another, each of said handle portions having proximal and distal ends;

an arcuate gripping handle having a pair of opposite ends, said gripping handle being positioned between said handle portions of said arm members, said ends of said gripping handle being coupled to said handle portion of said first arm member, one of said ends of said gripping handle being located towards said proximal end of said handle portion of said first arm member, another of said ends of said gripping handle being located towards said distal end of said handle portion of said first arm member;

an elongate first extension handle having a pair of opposite ends, one of said ends of said first extension handle being slidably mounted to said gripping handle; and an elongate second extension handle having a pair of opposite ends, one of said ends of said second extension handle being pivotally coupled to said handle portion of said second arm member.

7. The pliers of claim 4, wherein said gripping handle has a plurality of finger rings extending therefrom, said finger rings being positioned between said gripping handle and said first handle portion.

8. The pliers of claim 4, wherein said gripping handle has a plurality of finger grooves.

* * * * *